US007360382B2

(12) United States Patent
Fernández

(10) Patent No.: US 7,360,382 B2
(45) Date of Patent: Apr. 22, 2008

(54) CYLINDER LOCK ASSEMBLY

(75) Inventor: Juan A. Fernández, Brown Deer, WI (US)

(73) Assignee: Huf North America Parts Mfg. Corp., Milwaukee, WI (US)

( * ) Notice: Subject to any disclaimer, the term of this patent is extended or adjusted under 35 U.S.C. 154(b) by 0 days.

(21) Appl. No.: 11/348,020

(22) Filed: Feb. 6, 2006

(65) Prior Publication Data

US 2006/0225471 A1 Oct. 12, 2006

Related U.S. Application Data

(60) Provisional application No. 60/650,995, filed on Feb. 8, 2005.

(51) Int. Cl.
*E05B 29/00* (2006.01)

(52) U.S. Cl. ..... 70/360; 70/350; 70/352; 70/377

(58) Field of Classification Search ..... 70/350, 70/352, 360, 378, 423, 427
See application file for complete search history.

(56) References Cited

U.S. PATENT DOCUMENTS

| | | | | | |
|---|---|---|---|---|---|
| 2,123,940 | A | * | 7/1938 | Gray | 70/492 |
| 2,766,611 | A | * | 10/1956 | Hagel | 70/492 |
| 3,707,863 | A | * | 1/1973 | Schwab et al. | 70/492 |
| 3,735,614 | A | * | 5/1973 | Keller-Volper | 70/377 |
| 3,969,915 | A | * | 7/1976 | Droske | 70/492 |
| 4,074,548 | A | | 2/1978 | Milton | |
| 4,326,396 | A | * | 4/1982 | Steinbach | 70/492 |
| 4,601,184 | A | | 7/1986 | Doinel | |
| 4,682,484 | A | * | 7/1987 | Yeh | 70/492 |
| 5,174,141 | A | * | 12/1992 | Ohyabu | 70/492 |
| 5,355,703 | A | | 10/1994 | Elinski et al. | |

(Continued)

FOREIGN PATENT DOCUMENTS

DE 20 56 690 A1 5/1972

(Continued)

*Primary Examiner*—Patricia Engle
*Assistant Examiner*—Christopher Boswell
(74) *Attorney, Agent, or Firm*—Quarles & Brady LLP

(57) ABSTRACT

The cylinder lock assembly includes a cylindrical lock housing having an inner core extending between first and second ends. The inner core defines a core axis extending through the first and second ends. A lock cylinder is received in the inner core for rotational and axial movement in the inner core. The lock cylinder includes an axially extending key slot for receiving a key therein and a radially extending slot extending through the lock cylinder and intersecting the key slot. A rotation plate assembly is received in the radially extending slot and blocks at least a portion of the key slot. The rotation plate includes first and second rotation plate members which are movable relative to each other. A first biasing member engaging the first and second rotation plate members urges the second rotation plate member radially away from the first rotation plate member. The first and second rotation plate members define a space therebetween having a variable radial dimension for receiving therethrough the key received in the key slot, wherein upon insertion of the key through the space and into the key hole, the key engages the first rotation plate member to urge the first rotation plate member radially toward the second plate member against the urging of the first biasing member to allow the key to enter the key slot through the space.

19 Claims, 10 Drawing Sheets

U.S. PATENT DOCUMENTS 5,704,234 A 1/1998 Resch
5,848,540 A 12/1998 Pieper
6,098,434 A * 8/2000 Liou ..... 70/360
6,201,317 B1 3/2001 Kemmann et al.
6,236,121 B1 5/2001 Kemmann et al.
6,523,382 B1 2/2003 Dimig et al.

FOREIGN PATENT DOCUMENTS

EP 0 571 172 A 11/1993
JP 02279882 A * 11/1990

* cited by examiner

CYLINDER LOCK ASSEMBLY

CROSS REFERENCES TO RELATED APPLICATIONS

This application claims the priority benefit of U.S. Provisional Patent Application No. 60/650,995 filed on Feb. 8, 2005.

STATEMENT REGARDING FEDERALLY SPONSORED RESEARCH

Not Applicable

BACKGROUND OF THE INVENTION

This invention relates to a cylinder lock assembly, and in particular an automotive ignition lock cylinder having a lock cylinder that is axially and rotatably movable in an inner core of a cylindrical lock housing.

A prior art ignition lock assembly, shown in FIG. 1, for use in a vehicle includes a cylindrical lock housing having an inner core that receives a lock cylinder. The lock cylinder includes a key slot for receiving a key that engages tumblers housed in the lock cylinder. A spring biased rotation plate, or actuator, is retained in a radial slot formed in the lock cylinder by a rotation ring. A snap ring engaging an end of the lock cylinder retains the lock cylinder in the housing. The lock cylinder is axially movable in the lock housing to actuate an electrical device, such as a switch, and/or a mechanical device, such as a steering column lock, and is rotatable to actuate the vehicle ignition.

The prior art ignition lock assembly is operated by inserting a key into the key slot of the lock cylinder. Upon entry of the key into the key slot, the leading end of the key engages the rotation plate which prevents full insertion of the key into the key slot. The user must urge the rotation plate, and thus the entire lock cylinder, axially forward until the rotation plate is aligned with an opening formed adjacent the rotation ring. Upon alignment of the rotation plate with the opening, the rotation plate is urged radially into the rotation ring opening by a spring to lock the lock cylinder in an axially forward position and clear the key slot for further insertion of the key into the key slot. Unfortunately, the force required to urge the lock cylinder axially forwardly is annoying and detracts from the image of certain luxury vehicles.

SUMMARY OF THE INVENTION

The present invention provides a cylinder lock assembly including a rotation plate assembly that allows the insertion of a key into the cylinder lock assembly key slot without first forcing the lock cylinder axially. The cylinder lock assembly includes a cylindrical lock housing having an inner core extending between first and second ends. The inner core defines a core axis extending through the first and second ends. A lock cylinder is received in the inner core for rotational and axial movement in the inner core. The lock cylinder includes an axially extending key slot for receiving a key therein and a radially extending slot extending through the lock cylinder and intersecting the key slot. A rotation plate assembly is received in the radially extending slot and blocks at least a portion of the key slot.

The rotation plate includes first and second rotation plate members which are movable relative to each other. A first biasing member engaging the first and second rotation plate members urges the second rotation plate member radially away from the first rotation plate member. The first and second rotation plate members define a space therebetween having a variable radial dimension for receiving therethrough the key received in the key slot, wherein upon insertion of the key through the space and into the key hole, the key engages the first rotation plate member to urge the first rotation plate member radially toward the second plate member against the urging of the first biasing member to allow the key to enter the key slot through the space.

A general objective of the present invention is to provide a cylinder lock assembly that does not require axially moving the lock cylinder to insert the key into the key slot. This objective is accomplished by providing a rotation plate assembly including first and second rotation plate members that are movable relative and define a space therebetween to allow a key through the space and into the key slot without axially moving the lock cylinder.

Another objective of the present invention is to provide a cylinder lock assembly that moves the lock cylinder axially upon rotation of the lock cylinder. This objective is accomplished in a preferred embodiment of the invention by providing a camming member which extends radially from the lock cylinder and engages a camming surface formed on the cylindrical lock housing to urge the lock cylinder axially upon rotation of the lock cylinder.

The foregoing and other objects and advantages of the invention will appear from the following description. In the description, reference is made to the accompanying drawings which form a part hereof, and in which there is shown by way of illustration a preferred embodiment of the invention.

Figure 1:
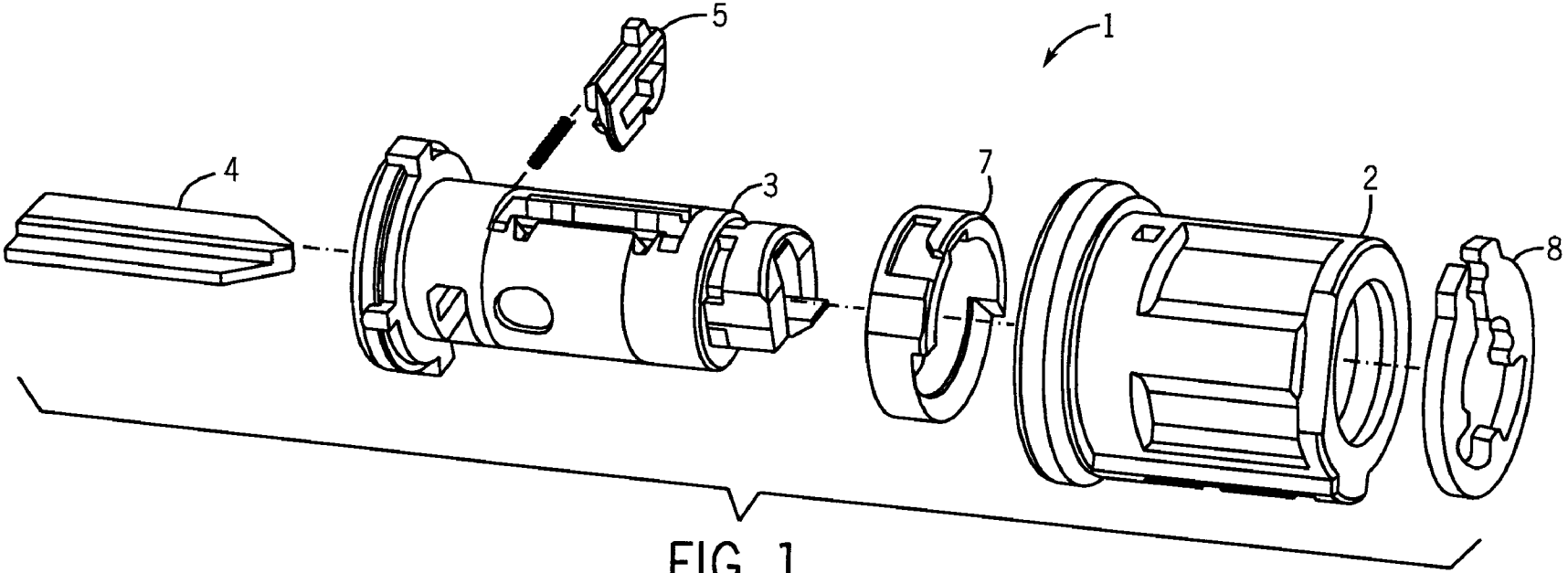
FIG. 1 PRIOR ART
FIG. 1 is a perspective, exploded view of a prior art ignition lock assembly.

Before a preferred embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

As shown in FIGS. 2-12, an improved ignition lock assembly 10 includes a rotation plate assembly 12 that reduces the force required to insert a key 14 into a key slot 16 formed in the ignition lock assembly 10. The ignition lock assembly 10 shown in FIG. 2 includes a cylindrical lock housing 18, a rotation ring 20, and a lock cylinder 22. As in the prior art, the key slot 16 formed in the lock cylinder 22 receives the key 14. In the present invention, a rotation plate assembly 24 received in the lock cylinder 22 allows insertion of the key 14 into the key slot 16 without first forcing the lock cylinder 22 axially forward. In addition, a camming member 26 extending radially from the lock cylinder 22 engages a camming surface 28 formed on a front end 38 of the lock housing 18 to axially move the lock cylinder 22 upon rotation of the lock cylinder 22 by the fully inserted key 14.

The cylindrical lock housing 18 is formed from any suitable material, such as plastic, metal, and the like, and includes a cylindrical wall 32 defining a cylindrical core 34. The core 34 is coaxial with a core axis 40 extending through the axial ends 36, 38 of the housing 18. The housing 18 receives the lock cylinder 22 in the core 34 which extends through housing ends 36, 38. As is known in the art, a sidebar locking channel (not shown) formed in the cylindrical wall 32 opens into the core 34 and is engageable with a locking sidebar (not shown) forming part of the lock cylinder 22 to prevent rotation of the lock cylinder 22 in the lock housing 18.

The rear end 36 of the housing 18 includes an axially inner lip 42 radially spaced from the cylindrical core 34 and coaxial with the core axis 40. The axially inner lip 42 is joined to an axially rearward outer edge 44 of the housing cylindrical wall 32 and axially spaced from the core first open end 36 to define a first receptacle 46 for receiving the rotation ring 20. An axially outer lip 48 joined to an axially outer edge 50 of the axially inner lip 42 is radially spaced from the cylindrical core 34 and coaxial with the core axis 40 to define a second receptacle 52 axially spaced from the first receptacle 46 for receiving a rear end 54 of the lock cylinder 22.

The front end 38 of the housing 18 includes an axially forward facing edge 56 having an axial slot 62. One surface 64 of the slot 62 is substantially parallel to the core axis 40, while an opposing surface 66 of the slot 62 defines an angle with the core axis 40 to form the camming surface 28 leading to the axially forwardly facing edge 56.

The rotation ring 20 is received in the first receptacle 46 and is coaxial with the core axis 40. A radially outwardly facing surface 72 of the rotation ring 20 abuts the axially inner lip 42, and a radially inwardly facing surface 74 of the rotation ring 20 spaced from the radially outwardly facing surface 72 is, preferably, substantially flush with the inner core 34 to define an axial extension of the inner core 34 for receiving the lock cylinder 22. The radially inwardly and outwardly facing surfaces 74, 72 are joined by axially front and rear edges 76, 78. The axially rear edge 78 is substantially planar and abuts a face plate 80 closing the housing rear end 36.

The axially front edge 76 defines a gap 88 between the rotation ring 20 and the housing rearward edge 44 for engaging the rotation plate assembly 24, and includes a substantially planar semicircular portion 82 that has an axially forwardly facing surface 84 that abuts the axially rearward facing edge 44 of the housing cylindrical wall 32. The semicircular portion 82 is joined by a chamfered semicircular portion 85 having an axially forward facing surface 86 axially spaced from the axially forward facing surface 84 of the substantially planar semicircular portion 82. The axially forward facing surface 86 of the chamfered semicircular portion 85 defines the gap 88 between the axially rearward edge 44 of the housing cylindrical wall 32 and the chamfered semicircular portion 85 for engaging the rotation plate assembly 24.

The rotation ring 20 is fixed in the first receptacle 46 by a retention pin (not shown) and a nub 94. The nub 94 is received in a first axial slot 90 formed in the radially outwardly facing surface 72 of the rotation ring 20 which intersects a circumferential slot 92 formed in the radially outwardly facing surface 72. The axial and circumferential slots 90, 92 receive the nub 94, or locating pin, extending inwardly into the core 34 from the housing cylindrical wall 32 to properly locate the rotation ring 20 in the first receptacle 46 relative to the retention pin. Preferably, the retention pin is press fit through an aperture 96 formed through the cylindrical wall 32 and engages a flat 98 formed on the radially outwardly facing surface 72 of the rotation ring 20. In addition, the rotation ring 20 is preferably located in the first receptacle 46 to align an axial slot 100 formed in the inwardly facing surface 74 between the rotation ring edges 76, 78 with the sidebar locking channel formed in the cylindrical wall 32.

Figure 6:
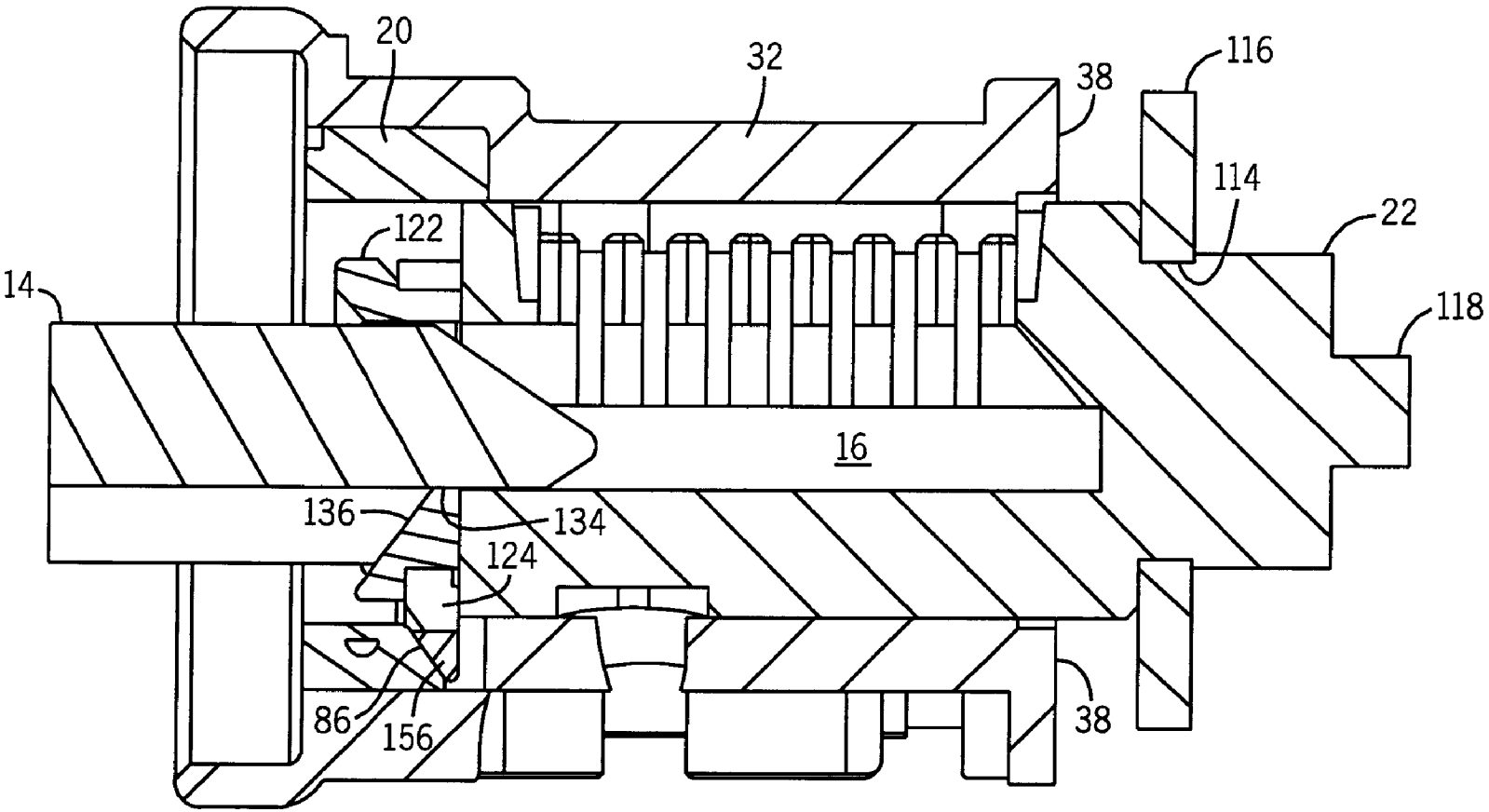
FIG. 6 is a cross sectional view of the ignition lock assembly of FIG. 2 with the lock cylinder in the forward position.
Figure 7:
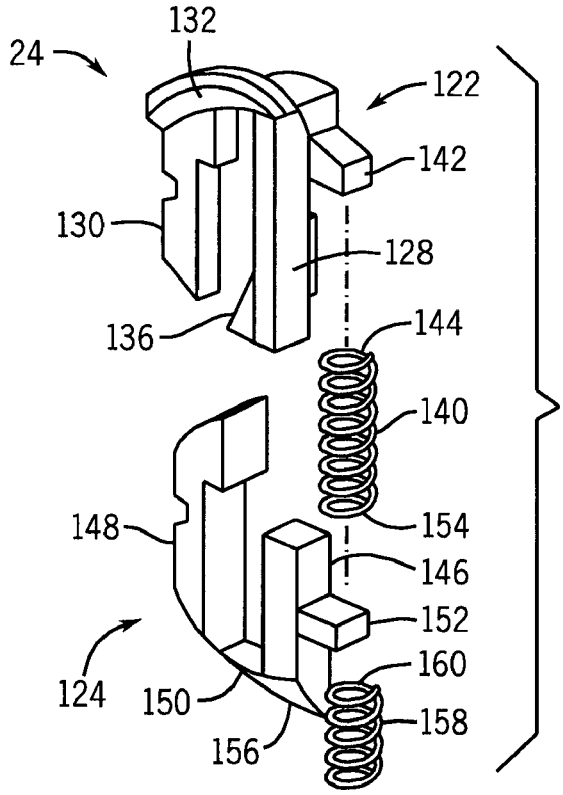
FIG. 7 is a rear perspective, exploded view of the rotation plate assembly of FIG. 2.
Figure 10:
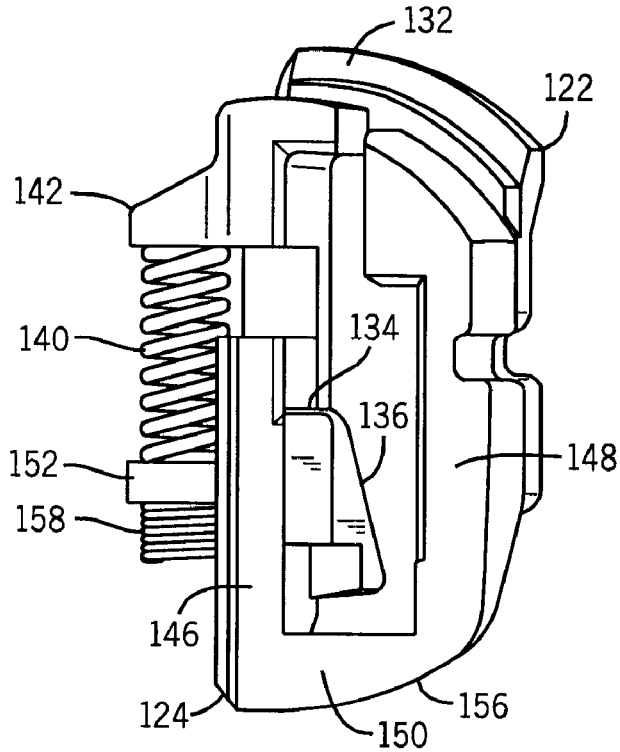
FIG. 10 is a front perspective view of the rotation plate assembly of FIG. 2 with the second rotation plate member unloaded and the second biasing member compressed.

The lock cylinder 22 is received through the cylindrical lock housing core 34 and rotation ring 20, and includes a cylindrical body 102 defining the axial key slot 16. The body 102 houses tumblers 104 engageable with the key 14 inserted in the key slot 16 to extend and retract the locking sidebar 39. As is known in the art, the proper key 14 aligns the tumblers 104 such that the lock cylinder 22 is rotatably and axially movable in the lock housing 18 between a rearward position (FIGS. 4 and 8) and a forward position (FIGS. 6 and 10).

As shown in FIGS. 2-6, the lock cylinder body 102 has a front end 108 and the rear end 54. The rear end 54 extends through and slidably engages a radially extending collar 109 having axially extending tabs 110 for receiving the face plate 80. The face plate 80 closes the rear end 36 of the housing 18, and has a key hole 115 aligned with the key slot 16 formed in the lock cylinder body 102 for receiving the key 14 therethrough. The collar 109, tabs 110, and face plate 80 are received in the second receptacle 52 formed adjacent the rear end 36 of the cylindrical lock housing 18. The tabs 110 fix the face plate 80 to the collar 109, and slidably engage the axially outer lip 48 of the first end 36 of the cylindrical lock housing 18.

The front end 108 of the lock cylinder body 102 extends through the front end 38 of the housing 18. Transverse slots 114 formed in a portion of the lock cylinder body front end 108 extending past the housing front end 38 engage a snap ring 116 to prevent the lock cylinder body 102 from slipping out of the cylindrical lock housing 18 through the first end 36 of the housing 18. An axially extending lever 118 extending from the lock cylinder body front end 108 is engageable with devices, such as an electronic switch, steering wheel lock, and the like, when the lock cylinder 22 is in the forward position. A radial slot 120 extending through the lock cylinder 22 proximal its rear end 54 receives the rotation plate assembly 24 that holds the lock cylinder 22 in the forward position when the key 14 is fully inserted into the key slot 16 and the lock cylinder 22 has moved into the forward position, such as upon rotation of the lock cylinder 22 by the user, as described below.

Referring to FIGS. 2, 4-6, and 8-10, the rotation plate assembly 24 intersects and blocks the key slot 16 formed in the lock cylinder 22, and includes first and second rotation plate members 122, 124. The first and second rotation plate members 122, 124 are movable relative to each other, and define a space 126 therebetween having a variable radial dimension. The variable dimension space 126 allows the insertion of the key 14 into the key slot 16 through the space 126 without first urging the entire lock cylinder 22 in an axial direction. Advantageously, upon insertion of the key 14 into the key slot 16 through the space 126, the second rotation plate member 124 is loaded for locking the lock cylinder 22 in the forward position upon axial movement of the lock cylinder 22 to the forward position.

The first rotation plate member 122 includes a pair of spaced sidebars 128, 130 having one end joined by a cross bar 132. One of the sidebars 128 includes a ledge 134 extending toward the other sidebar 130. A rearward facing ramp 136 leading up to the ledge 134 engages the key 14 inserted into the space 126 to urge the first rotation plate member 122 toward the second rotation plate member 124. A second rearward facing ramp 138 formed in the crossbar 132 guides the key 14 into the space 126 and into engagement with the ledge 134. Advantageously, engaging the key 14 with the ledge 134 as the key 14 is inserted through the space 126 into the key slot 16 compresses a first biasing member 140 interposed between the first and second rotation plate members 122, 124. Preferably, an arm 142 extending from the one sidebar 128 away from the other sidebar 130 engages one end 144 of the first biasing member 140, such as a helical spring, which biases the second rotation plate member 124 away from the first rotation plate member 122.

The second rotation plate member 124 also includes a pair of spaced sidebars 146, 148 joined at one end by a crossbar 150. The sidebars 146, 148 of the second rotation plate member 124 slidably engage the sidebars 128, 130 of the first rotation plate member 122, and in cooperation with the first rotation plate member 122 define the space 126 therebetween for receiving the key. An arm 152 extending from one of the second rotation plate member sidebars 146 engages an opposing end 154 of the first biasing member 140. A beveled lip 156 formed on the crossbar 150 of the second rotation plate member 124 extends away from the first rotation plate member 122, and is received in the gap 88 to lock the lock cylinder 22 in the forward position.

Figure 5:
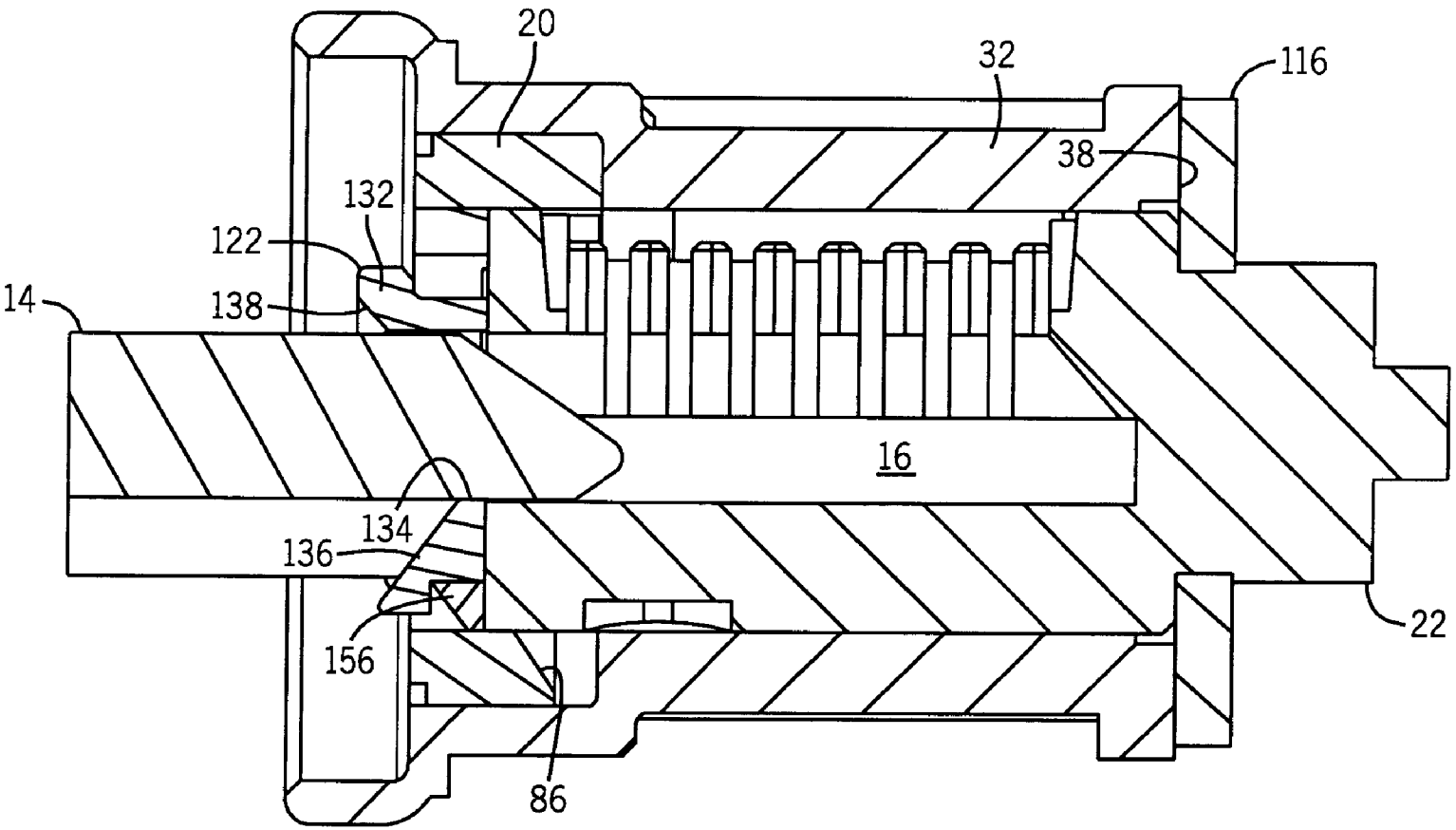
FIG. 5 is a cross sectional view of the ignition lock assembly of FIG. 2 upon insertion of a key into the key slot with the lock cylinder in the rearward position.
Figure 9:
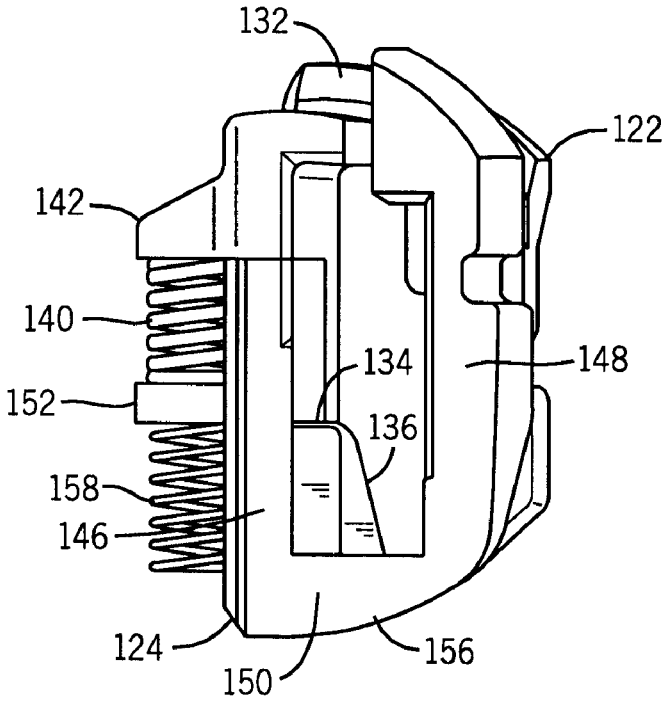
FIG. 9 is a front perspective view of the rotation plate assembly of FIG. 2 with the second rotation plate member loaded.

The first biasing member 140 is, preferably, interposed between the arms 142, 152 of the first and second rotation plate members 122, 124, and biases the second rotation plate member 124 away from the first rotation plate member 122 upon insertion of the key 14 into the space 126. Although a single helical spring is preferred, one or more biasing members, such as the helical spring, an elastomeric material, a leaf spring, and the like, can be used without departing from the scope of the invention. As shown in FIGS. 5 and 9, upon entry of the key 14 into the space 126 and engagement of the key 14 with the ledge 134 extending from the first rotation plate member sidebar 128 into the space 126, the key 14 urges the first rotation plate member 122 towards the second rotation plate member 124 and compresses the first biasing member 140 interposed between the arms 142, 152. The compressed first biasing member 140 "loads" the second rotation plate member 124, such that, as shown in FIGS. 6 and 10, upon alignment of the beveled lip 156 with the gap 88 between the axially outer edge 58 of the housing cylindrical wall 32 and the chamfered semicircular portion 85 of the rotation ring 20, the first biasing member 140 urges the beveled lip 156 into the gap 88 to hold the lock cylinder 22 in the forward position.

A second biasing member 158 interposed between the second rotation plate member 124 and the rotation ring 20 urges the beveled lip 156 out of the gap 88 upon removal of the key 14 from the key slot 16. Preferably, the second biasing member 158 is a helical spring having one end 160 engaging the arm 152 extending from the second rotation plate member sidebar 148 urges the second rotation plate member 124 radially against the urging of the first biasing member 140. As a result, upon removal of the key 14 from the key slot 16, and thus the space 126, the second rotation plate member 124 is "unloaded" (i.e. the first biasing member is uncompressed) and the second biasing member 158 overcomes the urging of the first biasing member 140 to urge the second rotation plate member beveled lip 156 radially out of the gap 88 to allow axial movement of the lock cylinder 22 toward the rearward position.

Figure 2:
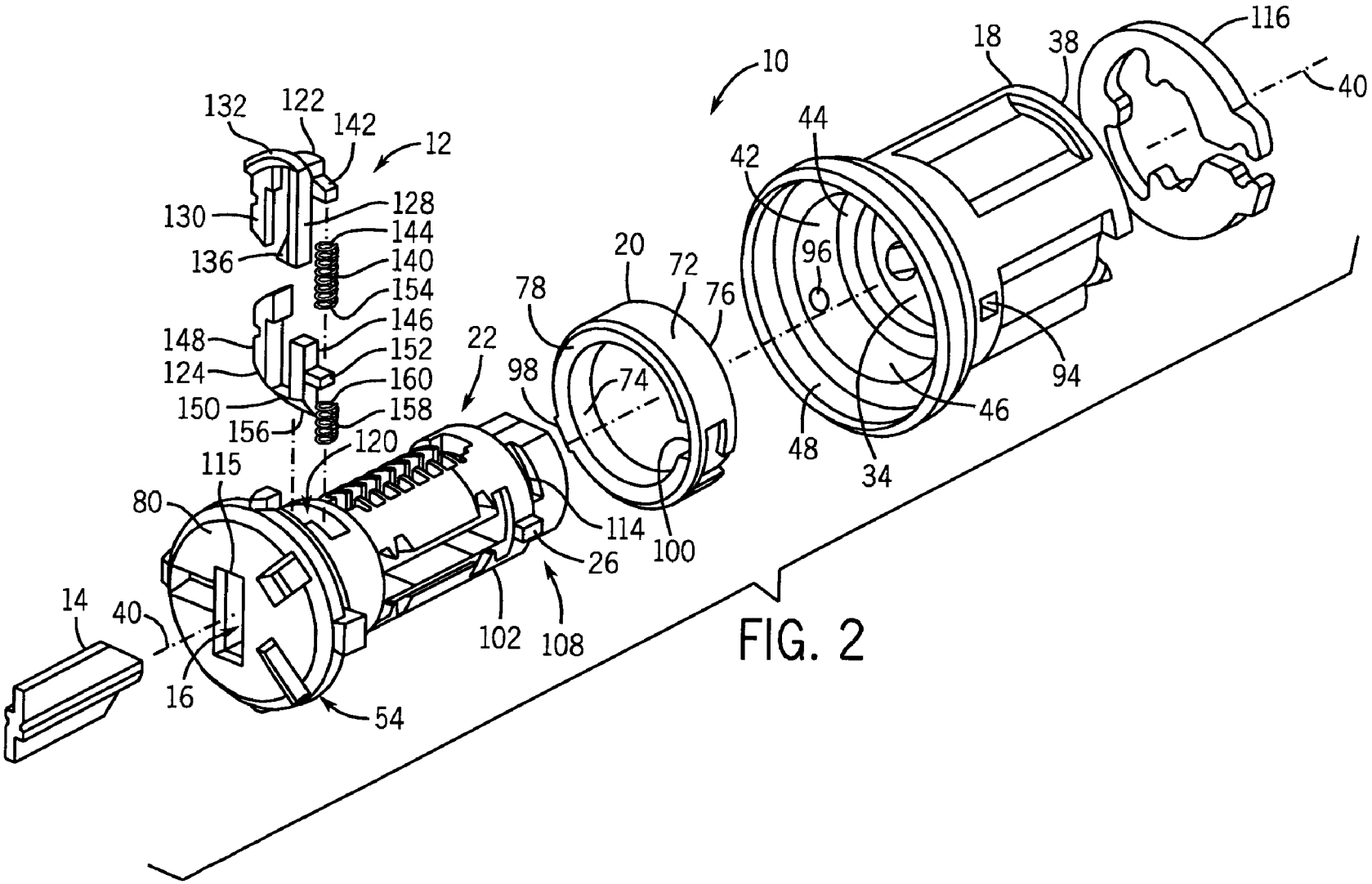
FIG. 2. is a rear perspective, exploded view of an ignition lock assembly incorporating the present invention.
Figure 3:
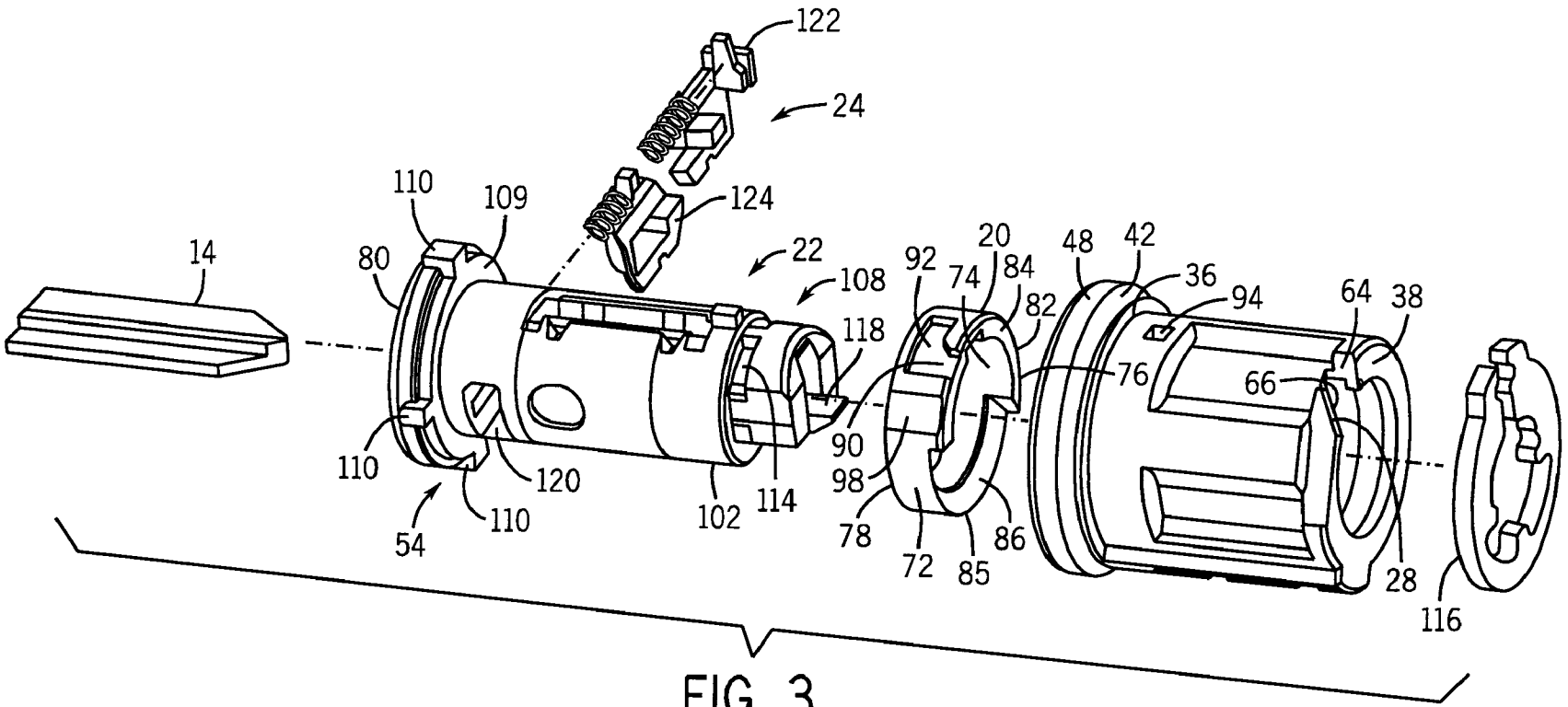
FIG. 3. is a front perspective, exploded view of the ignition lock assembly of FIG. 2.
Figure 11:
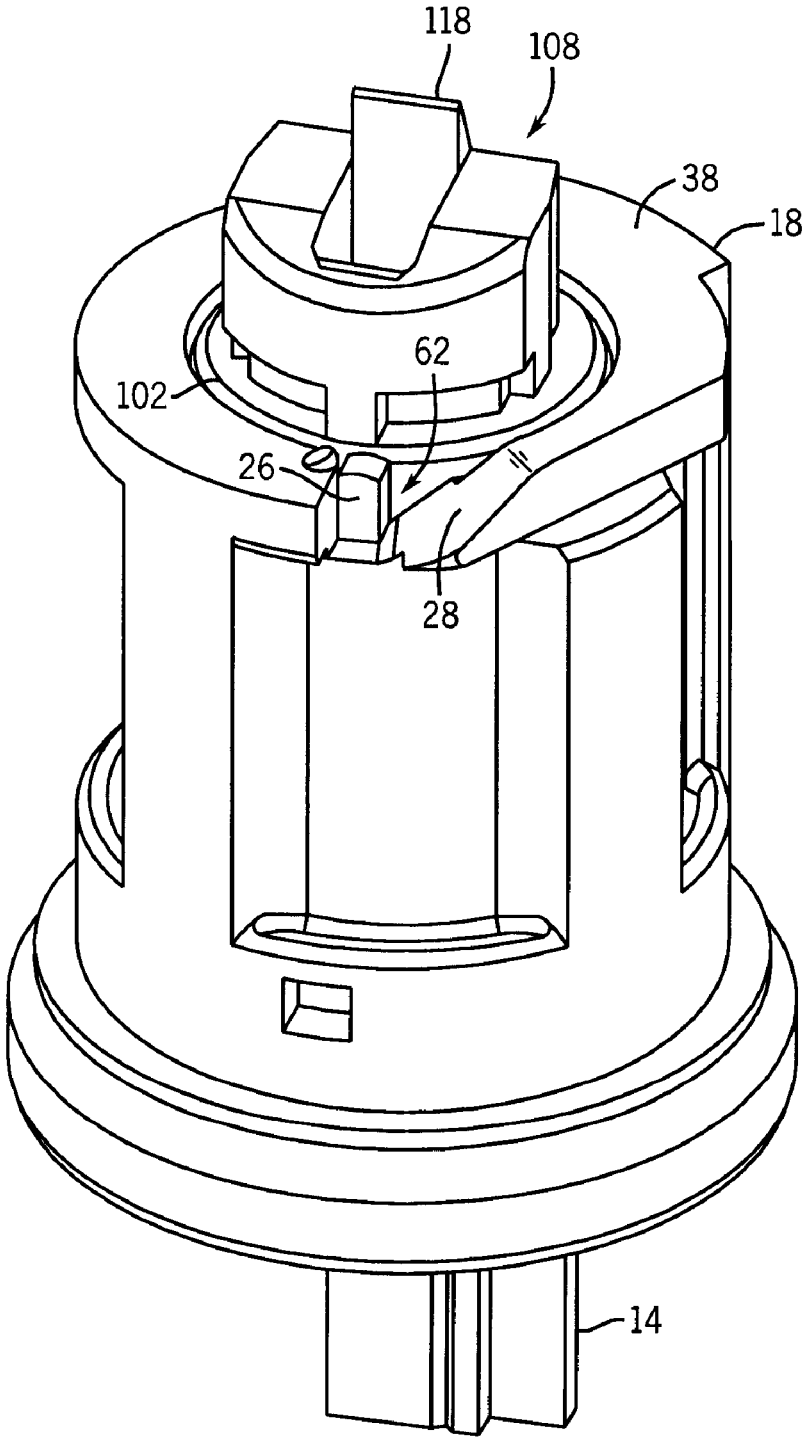
FIG. 11 is a side, rear perspective view of the ignition lock assembly of FIG. 2 prior to rotating the lock cylinder.
Figure 12:
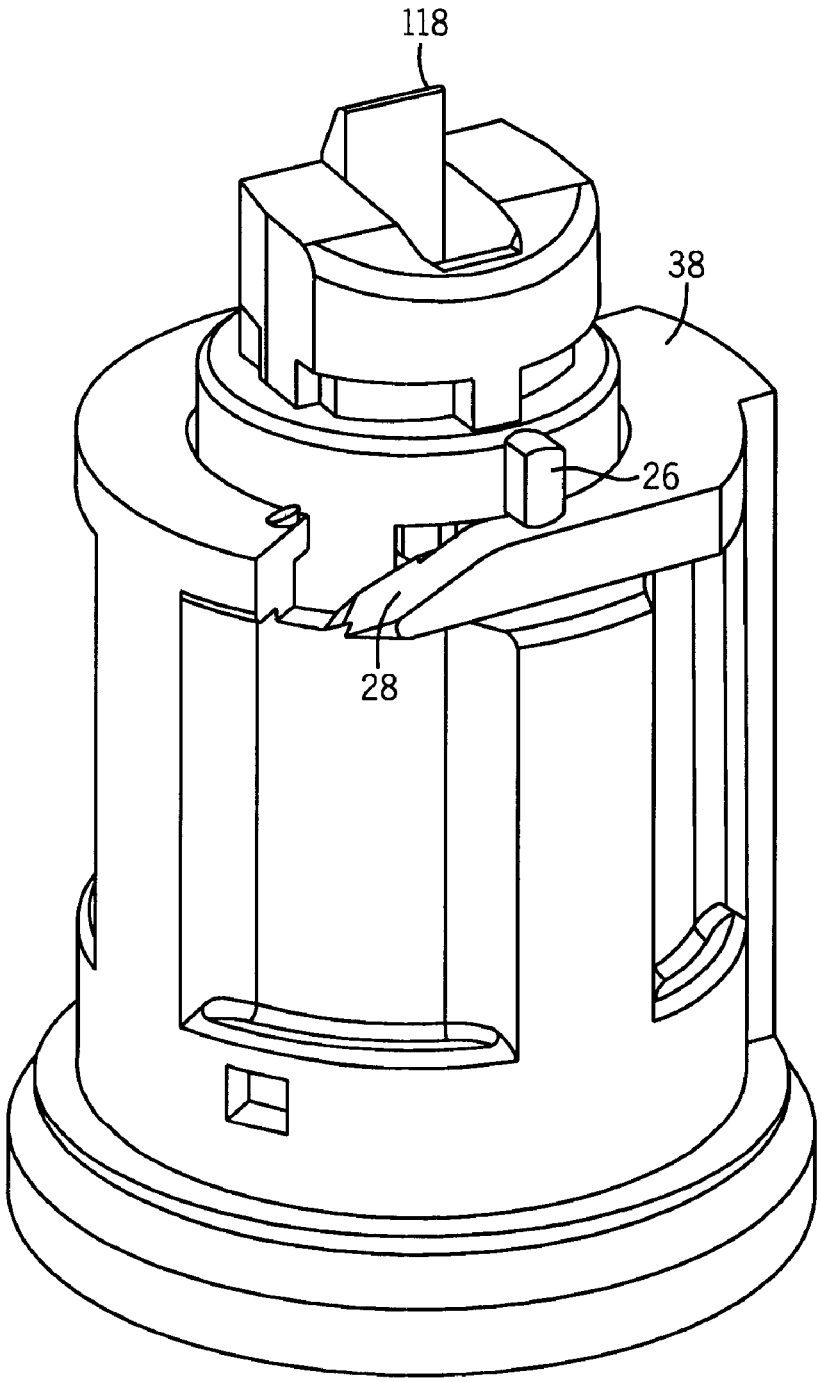
FIG. 12 is a side, rear perspective view of the ignition lock assembly of FIG. 2 after rotating the lock cylinder.

Referring now to FIG. 2, 11, and 12, the lock cylinder 22 is urged axially toward the forward position upon rotation of the lock cylinder 22 and engagement of the camming member 26 with the camming surface 28. The camming member 26, such as a pin, extends radially from the lock cylinder 22 proximal the front end 108 of the lock cylinder body 102. In the rearward position of the lock cylinder 22, the camming member 26 is received in the axial slot 62 formed in the front end of the cylindrical lock housing 18, and is engageable with the camming surface, 28. Rotating the lock cylinder 22 engages the camming member 26 with the camming surface 28 which drives the lock cylinder 22 axially toward the forward position to engage the lever 118 with a device. Advantageously, the camming member 26 and camming surface 28 eliminates the need for a user to urge the lock cylinder 22 in the axial direction. Of course, if desired, the user can urge the lock cylinder 22 axially to circumvent the axially driving force of the camming surface 28 engaging the camming member 26 without departing from the scope of the invention.

In use, referring to FIGS. 2-12, the key 14 inserted into the key slot 16 through the key hole 115 formed in the face plate 80 is guided into the space 126 defined between the first and second rotation plate members 122, 124 by the rearwardly facing ramps 136, 138. As shown in FIGS. 5 and 9, as the key 14 enters the space 126, it engages the first rotation plate member ledge 134 and urges the first rotation plate member 122 toward the second rotation plate member 124 to compress the first biasing member 140 and "load" the second rotation plate member 124. Upon further insertion of the proper key 14 into the key slot 16, the tumblers 104 allow rotation and axial movement of the lock cylinder 22.

Rotation of the lock cylinder 22 engages the camming member 26 with the camming surface 28 to pull the lock cylinder 22 axially toward the forward position and engage the axially extending lever 118 with a device. Advantageously, rotation of the lock cylinder 22 urges the lock cylinder 22 axially forward, as opposed to an axial force exerted onto the lock cylinder 22 by the user, to provide a smooth and non-annoying action by the user. Of course, the lock cylinder 22 can be urged forwardly by the user to lock the lock cylinder 22 in the forward position, as in the prior art ignition lock assembly.

As shown in FIGS. 6 and 10, upon reaching the forward position, the second rotation plate member 124 is aligned with the gap 88 between the axially outer edge 58 of the housing cylindrical wall 32 and the chamfered semicircular portion 85 of the rotation ring 20. Once the second rotation plate member 124 is aligned with the gap 88, the first biasing member 140 urges the beveled lip 156 of the second rotation plate member 124 into the gap 88 to lock the lock cylinder 22 in the forward position until the key 14 is removed from the space 126.

Figure 4:
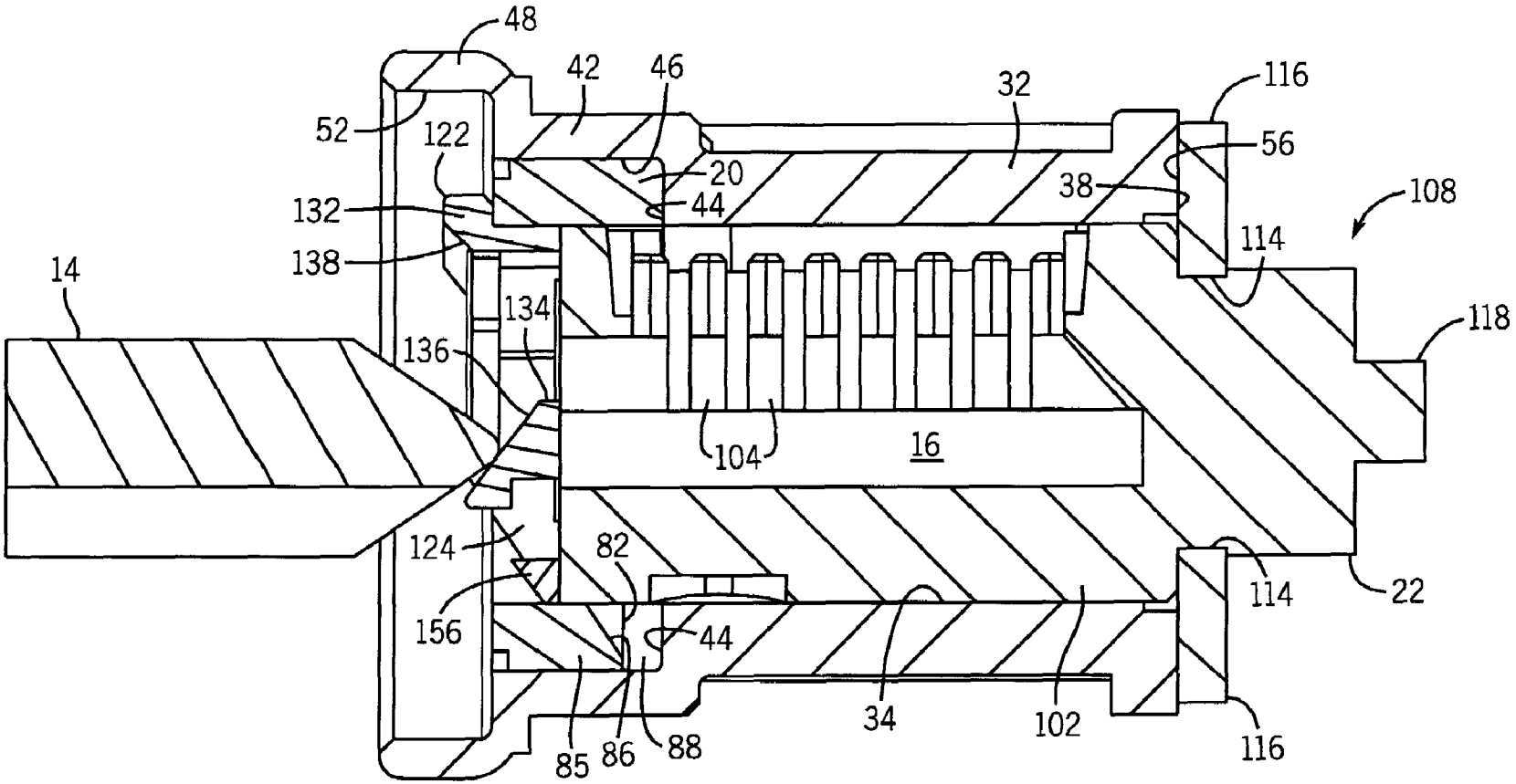
FIG. 4 is a cross sectional view of the ignition lock assembly of FIG. 2 prior to the insertion of a key into the key slot.
Figure 8:
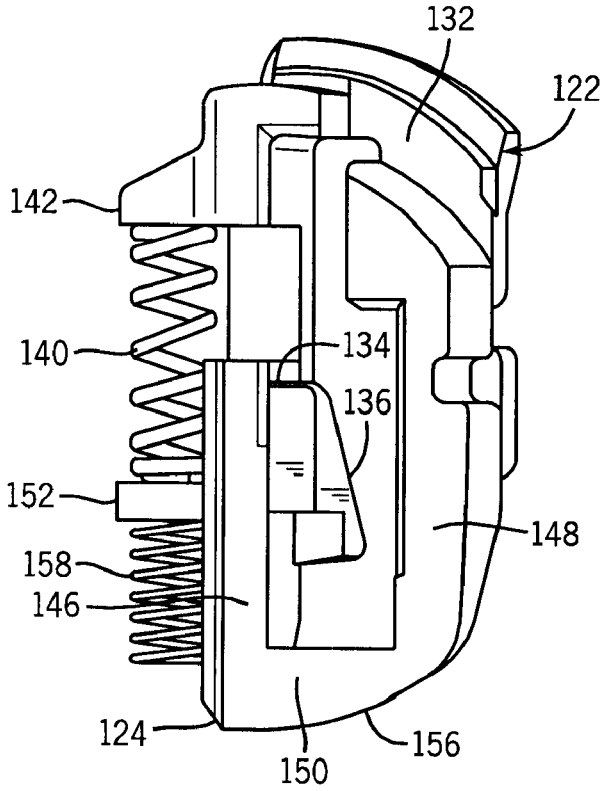
FIG. 8 is a front perspective view of the rotation plate assembly of FIG. 2 with the second rotation plate member unloaded.

As shown in FIGS. 4 and 8, upon removal of the key 14 from the key slot 16, and thus the space 126, the second biasing member 158 urges the beveled lip 156 out of the gap 88, and the first biasing member 140 urges the first rotation plate member 122 radially into the key slot 16. Upon disengagement of the beveled lip 156 from the gap 88, the lock cylinder 22 is free to move axially back to the rearward position. Preferably, a third biasing member (not shown) interposed between the lock cylinder 22 and lock housing 18 urges the lock cylinder 22 toward the rearward position.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

I claim:

1. A cylinder lock assembly comprising:

a lock housing having an inner core extending between first and second ends, said inner core defining a core axis extending through said first and second ends;

a lock cylinder received in said inner core for rotational and axial movement in said inner core, said lock cylinder including an axially extending key slot for receiving a key therein and a radially extending slot extending through said lock cylinder and intersecting said key slot, said lock cylinder being axially movable between a rearward position in said inner core and a forward position in said inner core, and a rotation plate assembly received in said radially extending slot and blocking at least a portion of said key slot, said rotation plate including first and second rotation plate members being movable relative to each other and a first biasing member engaging said first and second rotation plate members for urging said second rotation plate member radially away from said first rotation plate member said first and second rotation plate members defining a space therebetween having a variable radial dimension for receiving therethrough the key received in said key slot, wherein upon insertion of the key through said space and into said key hole, the key engages said first rotation plate member to urge said first rotation plate member radially toward said second plate member against the urging of said first biasing member to allow the key to enter said key slot through said space and lock said lock cylinder in said forward position.

2. The cylinder lock assembly as in claim 1, in which said first biasing member urges said second plate member into engagement with said lock housing to axially lock said lock cylinder relative to said lock housing in said forward position.

3. The cylinder lock assembly as in claim 1, in which said first rotation plate member includes a ledge extending into said space and engageable with the key to urge said first rotation plate member against the urging of said first biasing member.

4. The cylinder lock assembly as in claim 1 in which a first arm extends from said first rotation plate member and a second arm extends from said second rotation plate member, and said first biasing member is interposed between said first and second arms.

5. The cylinder lock assembly as in claim 4, in which said first biasing member is compressed upon engagement of said first rotation plate member with the key.

6. The cylinder lock assembly as in claim 1, in which said lock cylinder includes at least one of a camming surface and a cam, and said lock housing includes at least one of the other of said camming surface and said cam which engages said least one of a camming surface and a cam, wherein upon rotation of said lock cylinder, said least one of a camming surface and a cam engages said other of said least one of said camming surface and said cam to axially move said lock cylinder to said forward position.

7. The cylinder lock assembly as in claim 1, further including a second biasing member engaging said second rotation plate member for urging said second rotation plate member toward said first rotation plate member against the urging of said first biasing member.

8. A cylinder lock assembly comprising:

a lock housing having an inner core extending between first and second ends, said inner core defining a core axis extending through said first and second ends;

a lock cylinder received in said inner core for rotational and axial movement in said inner core, said lock cylinder including an axially extending key slot for receiving a key therein and a radially extending slot extending through said lock cylinder and intersecting said key slot, said lock cylinder being axially movable between a rearward position in said inner core, and a rotation plate assembly received in said radially extending slot and blocking at least a portion of said key slot; and at least one of a camming surface and a cam extending from said lock cylinder, and said lock housing includes at least one of the other of said camming surface and said cam which engages said least one of a camming surface and a cam extending from said lock cylinder, wherein upon rotation of said lock cylinder, said least one of a camming surface and a cam engages said other of said least one of said camming surface and said cam to axially move said lock cylinder in said inner core to said forward position from said rearward position, wherein said rotation assembly locks said lock cylinder in said forward position.

9. The cylinder lock assembly as in claim 8, in which said rotation plate including first and second rotation plate members being movable relative to each other, a first biasing member engaging said first and second rotation plate members for urging said second rotation plate member radially away from said first rotation plate member, said first and second rotation plate members defining a space therebetween having a variable radial dimension for receiving therethrough the key received in said key slot, wherein upon insertion of the key through said space and into said key hole, the key engages said first rotation plate member to urge said first rotation plate member radially toward said second plate member against the urging of said first biasing member to allow the key to enter said key slot through said space.

10. The cylinder lock assembly as in claim 9, in which said first biasing member urges said second plate member into engagement with said lock housing to axially lock said lock cylinder relative to said lock housing.

11. The cylinder lock assembly as in claim 9, in which said first rotation plate member includes a ledge extending into said space and engageable with the key to urge said first rotation plate member against the urging of said first biasing member.

12. The cylinder lock assembly as in claim 9 in which a first arm extends from said first rotation plate member and a second arm extends from said second rotation plate member, and said first biasing member is interposed between said first and second arms.

13. The cylinder lock assembly as in claim 12, in which said first biasing member is compressed upon engagement of said first rotation plate member with the key.

14. The cylinder lock assembly as in claim 9, further including a second biasing member engaging said second rotation plate member for urging said second rotation plate member toward said first rotation plate member against the urging of said first biasing member.

15. A cylinder lock assembly comprising:

a lock housing having an inner core extending between first and second ends, said inner core defining a core axis extending through said first and second ends;

a lock cylinder received in said inner core for rotational and axial movement in said inner core, said lock cylinder including an axially extending key slot for receiving a key therein and a radially extending slot extending through said lock cylinder and intersecting said key slot, said lock cylinder being axially movable between a rearward position in said inner core, and a forward position in said inner core, and a rotation plate assembly received in said radially extending slot and blocking at least a portion of said key slot, said rotation plate including first and second rotation plate members being movable relative to each other, a first biasing member engaging said first and second rotation plate members for urging said second rotation plate member radially away from said first rotation plate member, and a second biasing member engaging said second rotation plate member for urging said second rotation plate member toward said first rotation plate member against the urging of said first biasing member, said first and second rotation plate members defining a space therebetween having a variable radial dimension for receiving therethrough the key received in said key slot, wherein upon insertion of the key through said space and into said key hole, the key engages said first rotation plate member to urge said first rotation plate member radially toward said second plate member against the urging of said first biasing member to allow the key to enter said key slot through said space and lock said lock cylinder in said forward position; and at least one of a camming surface and a cam extending from said lock cylinder, and said lock housing includes at least one of the other of said camming surface and said cam which engages said least one of a camming surface and a cam extending from said lock cylinder, wherein upon rotation of said lock cylinder, said least one of a camming surface and a cam engages said other of said least one of said camming surface and said cam to axially move said lock cylinder in said inner core to said forward position.

16. The cylinder lock assembly as in claim 15, in which said first biasing member urges said second plate member into engagement with said lock housing to axially lock said lock cylinder relative to said lock housing.

17. The cylinder lock assembly as in claim 15, in which said first rotation plate member includes a ledge extending into said space and engageable with the key to urge said first rotation plate member against the urging of said first biasing member.

18. The cylinder lock assembly as in claim 15 in which a first arm extends from said first rotation plate member and a second arm extends from said second rotation plate member, and said first biasing member is interposed between said first and second arms.

19. The cylinder lock assembly as in claim 18, in which said first biasing member is compressed upon engagement of said first rotation plate member with the key.

* * * * *

UNITED STATES PATENT AND TRADEMARK OFFICE

CERTIFICATE OF CORRECTION

PATENT NO. : 7,360,382 B2
APPLICATION NO. : 11/348020
DATED : April 22, 2008
INVENTOR(S) : Juan A. Fernandez It is certified that error appears in the above-identified patent and that said Letters Patent is hereby corrected as shown below:

Claim 8, column 8, line 41
"core; and" should be
--core and a forward position in said inner core; and--

Signed and Sealed this

Sixteenth Day of September, 2008

JON W. DUDAS
*Director of the United States Patent and Trademark Office*